US010562308B1

(12) United States Patent
Atwood et al.

(10) Patent No.: US 10,562,308 B1
(45) Date of Patent: Feb. 18, 2020

(54) SYSTEM AND METHOD FOR PRIMING AN INK DELIVERY SYSTEM IN AN INKJET PRINTER

(71) Applicant: Xerox Corporation, Norwalk, CT (US)

(72) Inventors: Christopher D. Atwood, Rochester, NY (US); Michael A. Durfee, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/214,528

(22) Filed: Dec. 10, 2018

(51) Int. Cl.
*B41J 2/175* (2006.01)
*B41J 2/165* (2006.01)

(52) U.S. Cl.
CPC ..... *B41J 2/16523* (2013.01); *B41J 2/17596* (2013.01)

(58) Field of Classification Search
CPC .. B41J 2/16523; B41J 2/17596; B41J 2/1721; B41J 2002/1856
See application file for complete search history.

(56) References Cited

U.S. PATENT DOCUMENTS 8,439,493 B2 * 5/2013 Rosati ..... B41J 2/175 347/89
2008/0246823 A1 10/2008 Comas et al.
2009/0219331 A1 9/2009 Esdaile-Watts et al.
2013/0293640 A1 11/2013 McCallum et al.
2017/0096014 A1 * 4/2017 Bryant ..... B41J 2/16523

* cited by examiner

*Primary Examiner* — Jason S Uhlenhake
(74) *Attorney, Agent, or Firm* — Maginot Moore & Beck LLP

(57) ABSTRACT

A jumper is configured to replace a printhead connected to an ink delivery system to enable a controller operating the ink delivery system to prime the ink supply conduit and the ink waste conduit of the ink delivery system. The jumper includes a pressure impedance element that simulates a pressure drop across the printhead when the printhead is connected to the ink delivery system. The jumper enables the ink supply conduit and the waste ink conduit to be primed with reduced risk of air being urged into the inkjets of the printhead once the printhead is reconnected to the ink delivery system.

20 Claims, 5 Drawing Sheets

SYSTEM AND METHOD FOR PRIMING AN INK DELIVERY SYSTEM IN AN INKJET PRINTER

TECHNICAL FIELD

This disclosure relates generally to devices that produce ink images on media, and more particularly, to devices that eject fast-drying ink from inkjets to form ink images.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. The frequency and amplitude of the firing signals correspond to the selective activation of the printhead actuators. The printhead actuators respond to the firing signals by expanding into an ink chamber to eject ink drops onto an image receiving member and form an ink image that corresponds to the digital image used to generate the firing signals.

FIG. 4 illustrates a prior art high-speed aqueous ink image producing machine or printer 10. As illustrated, the printer 10 is a printer that directly forms an ink image on a surface of a web W of media pulled through the printer 10 by the controller 80' operating one of the actuators 40 that is operatively connected to the shaft 42 about which a take up roll 46 is mounted. The printhead modules can be configured to have only one printhead that has a width that corresponds to a width of the widest media in the cross-process direction that can be printed by the printer or the printhead modules can be configured with a plurality of printheads with each printhead having a width that is less than a width of the widest media in the cross-process direction that the printer can print. In these modules having multiple printheads, the printheads are arranged in an array of staggered printheads that enables media wider than a single printhead to be printed. Additionally, the printheads can also be interlaced so the density of the drops ejected by the printheads in the cross-process direction can be greater than the smallest spacing between the inkjets in a printhead in the cross-process direction. A printhead module is provided for each color used by the printer 10.

After an ink image is printed on the web W, the image passes under an image dryer 30. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

As further shown, the media web W is unwound from a roll of media 38 as needed by controller 80 operating one or more actuators 40 to rotate the shaft 42 on which the take up roll 46 is placed to pull the web from the media roll 38 as it rotates about the shaft 36. When the web is completely printed, the take-up roll can be removed from the shaft 42 for additional processing. Alternatively, the printed web can be directed to other processing stations (not shown) that perform tasks such as cutting, collating, binding, and stapling the media.

Operation and control of the various subsystems, components and functions of the machine or printer 10 are performed with the aid of a controller or electronic subsystem (ESS) 80. The ESS or controller 80 is operably connected to the components of an ink delivery system 20, a purge system 24, the printhead modules 34A-34D (and thus the printheads), actuators 40, heater 30, and a user interface 50. In operation, image data for an image to be produced are sent to the controller 80 from either a scanning system or an online or work station connection for processing and generation of the printhead control signals output to the printhead modules 34A-34D. Additionally, the controller 80 determines and accepts related subsystem and component controls, for example, from operator inputs via the user interface 50, and accordingly executes such controls. As a result, aqueous ink for appropriate colors are delivered to the printhead modules 34A-34D. Additionally, pixel placement control is exercised relative to the surface of the web to form ink images corresponding to the image data, and the media can be wound on the take-up roll or otherwise processed.

Using like numbers for like components, a prior art ink delivery system 20 used in printer 10 is shown in FIG. 5. The ink delivery system 20 includes an ink supply reservoir 604 that is connected to a printhead 608 and is positioned below the printhead so the ink level can be maintained at a predetermined distance D below the printhead to provide an adequate back pressure on the ink in the printhead. This back pressure helps ensure good ink drop ejecting performance. The ink reservoir is operatively connected to a source of ink (not shown) that keeps the ink at a level that maintains the distance D. The printhead 608 has a manifold that stores ink until an inkjet pulls ink from the manifold. The capacity of the printhead manifold is typically five times the capacity of all of the inkjets. The inlet of the manifold is connected to the ink reservoir 604 through a conduit 618 and a conduit 634 connects the outlet of the manifold to a waste ink tank 638. A valve 642 is installed in the conduit 634 to selectively block the conduit 634. A valve 612 is also provided in the conduit 614 connecting an air pressure pump 616 to the ink reservoir 604 and this valve remains open to vent the reservoir to atmosphere except during purging operations.

When a new printhead is installed or an incident occurs, such as an ink reservoir repair or replacement of an ink supply tube, air or air bubbles can exist in the conduit 618 or the manifold of the printhead. To clear the air and prime the supply lines and printhead with ink, a manifold purge is performed. In a manifold purge, the controller 80 operates the valve 642 to enable fluid to flow from the manifold outlet to the waste ink tank 638, activates the air pressure pump 616, and operates the valve 612 to close the ink reservoir to atmospheric pressure so pump 616 can pressurize the ink in the ink reservoir 604. The pressurized ink flows through conduit 618 to the manifold inlet of printhead 608. Because valve 642 is also opened, the pneumatic impedance to fluid flow from the manifold to the inkjets is greater than the pneumatic impedance through the manifold. Thus, ink flows from the manifold outlet to the waste tank. The pressure pump 616 is operated at a predetermined pressure for a predetermined period of time to push a volume of ink through the conduit 618 and the manifold of the printhead 608 that is sufficient to fill the conduit 618, the manifold in the printhead 608, and the conduit 634 without completely exhausting the supply of ink in the reservoir. The controller then operates the valve 642 to close the conduit 634 and operates the valve 612 to vent the ink reservoir to atmospheric pressure. Thus, a manifold purge fills the conduit 618 from the ink reservoir to the printhead, the manifold, and the conduit 634 so the manifold and the ink delivery system are primed since no air is present in the conduits or the printhead. The ink reservoir is then resupplied to bring the height of the ink to a level where the distance between the level in the reservoir and the printhead inkjets is D, as previously noted.

To prime the inkjets in the printhead 608 following a manifold prime, the controller 80 closes the valve 612 and activates the air pressure pump 616 to pressurize the head space of the reservoir 604 to send ink to the printhead. Because the valve 642 is closed, the pneumatic impedance of the primed system through the manifold is greater than the pneumatic impedance through the inkjets so ink is urged into the inkjets. Again, the purge pressure is exerted at a predetermined pressure for a predetermined period of time to urge a volume of ink into the printhead that is adequate to fill the inkjets. Any ink previously in the inkjets is emitted from the nozzles in the faceplate 624 of the printhead 608. This ink purging primes the inkjets and can also help restore clogged and inoperative inkjets to their operational status. After the exertion of the pressure, the controller 80 operates the valve 612 to open and release pressure from the ink reservoir. A pressure sensor 620 is also operatively connected to the pressure supply conduit 622 and this sensor generates a signal indicative of the pressure in the reservoir. This signal is provided to the controller 80 for regulating the operation of the air pressure pump. If the pressure in the reservoir during purging exceeds a predetermined threshold, then the controller 80 operates the valve 612 to release pressure or reduce the output of the pressure source 616. If the pressure in the reservoir drops below a predetermined threshold during purging, then the controller 80 operates the pressure source 616 to raise the pressure. The two predetermined thresholds are different so the controller can keep the pressure in the reservoir in a predetermined range during purging rather than at one particular pressure.

When new printheads are being installed in a printer or supply lines are being replaced, the manifold purge described above can force air into the inkjets in some situations. If air enters too many inkjets, then the operational status of the printhead can be adversely affected. This condition is particularly important for some types of printheads that more easily trap air bubbles in the inkjets of a printhead than some other types of printheads. The capacity of the ink reservoir 604 sometimes presents an issue as well as the reservoir can be exhausted before the conduits are primed and that exhaustion brings air into the ink delivery system. The amount of ink that needs to be pushed to the waste tank to purge the system of air can be enough to render inkjets in the printhead inoperable and the printhead may need to be subjected to a recovery procedure, which may last as long as twelve hours. Enabling a priming procedure that fills the supply lines and waste ink lines with ink before the insertion of the printheads into the ink delivery system would be beneficial.

SUMMARY

A method of priming an ink delivery system uses a jumper to facilitate the filling of conduits of the ink delivery system before a printhead is installed in the system. The method includes disconnecting one end of an ink supply conduit from an inlet of a manifold of a printhead, disconnecting one end of a waste ink conduit from an outlet of the manifold of the printhead, connecting the one end of an ink supply conduit to an inlet of a jumper, another end of the ink supply conduit being connected to an ink reservoir, connecting the one end of the waste ink conduit to an outlet of the jumper, another end of the waste ink conduit being connected to a waste ink reservoir, operating with a controller a first valve operatively connected between the ink reservoir and an air pressure pump to connect the air pressure pump to an inlet of a jumper through the ink reservoir when the valve is in a first position, operating with the controller a second valve operatively connected between the waste ink reservoir and the outlet of the jumper to connect the jumper outlet to the waste ink reservoir when the valve is in a first position, and operating with the controller the air pressure pump to apply pressure to the ink in the ink reservoir to push ink from the ink reservoir through the inlet of the jumper to the outlet of the jumper and into the waste ink reservoir when the first valve and the second valve are both in the first position.

An ink delivery system is configured with a jumper to facilitate the filling of the ink conduits without the printhead being in the system. The ink delivery system includes a jumper having an inlet and an outlet, an ink supply conduit operatively connected at one end to an ink reservoir and operatively connected at another end to the inlet of the jumper, a waste ink conduit operatively connected at one end to a waste ink reservoir and operatively connected at another end to the outlet of the jumper, an air pressure pump operatively connected to the ink reservoir, the air pressure pump being configured to apply pressure to ink in the ink reservoir, a first valve operatively connected between the ink reservoir and the air pressure pump, the first valve being configured to be moved to a first position where the ink reservoir is vented to atmosphere pressure and to a second position where the air pressure pump applies pressure to the ink reservoir, a second valve operatively positioned in the waste ink conduit between the waste ink reservoir and the outlet of the jumper, the second valve being configured to be moved to a first position where ink from the jumper outlet flows to the waste ink reservoir and to a second position where ink flow from the jumper outlet to the waste ink reservoir is blocked, and a controller operatively connected to the first valve, the second valve, and the air pressure pump. The controller is configured to operate the first valve to connect the air pressure pump to the ink reservoir, to operate the second valve to connect the output of the jumper to the waste ink reservoir, and to operate the air pressure pump to apply pressure to the ink in the ink reservoir to push ink from the ink reservoir through the ink supply conduit to the jumper and from the outlet of the jumper through the waste ink conduit into the waste ink reservoir.

BRIEF DESCRIPTION OF THE DRAWINGS

The foregoing aspects and other features of a system and method that enable an ink delivery system to be primed without the printhead being installed in the system are explained in the following description, taken in connection with the accompanying drawings.

DETAILED DESCRIPTION

Figure 1:
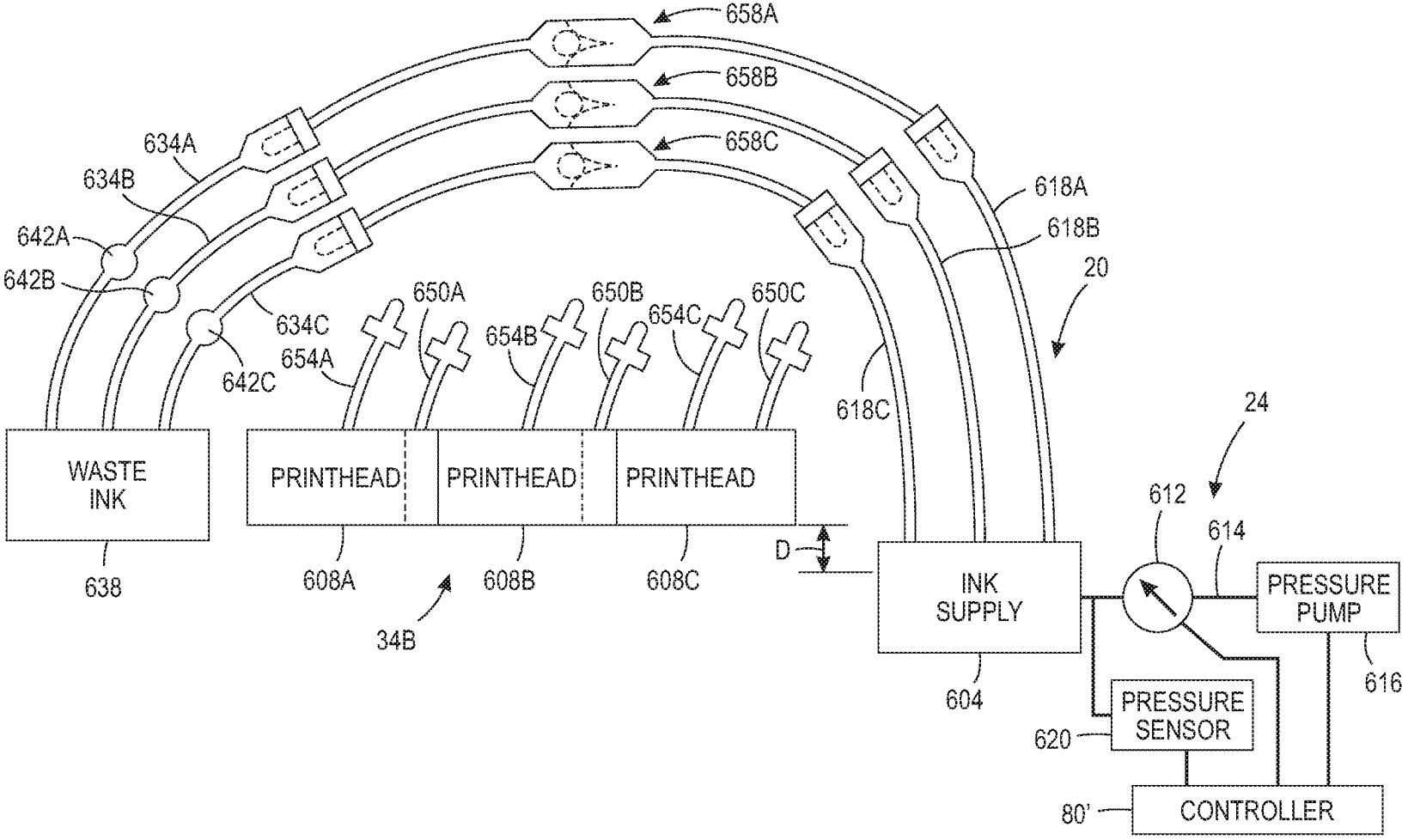
FIG. 1 is a schematic diagram of a printhead module with a jumper replacing the printhead in the system that facilitates the priming of the conduits in the system.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. Also, the description presented below is directed to a system for priming a printhead and ink delivery system in an inkjet printer. The reader should also appreciate that the principles set forth in this description are applicable to similar imaging devices that generate images with pixels of marking material.

FIG. 1 depicts the printheads 608A, 608B, and 608C of magenta printhead module 34B disconnected from the ink supply system 20. The three printheads are configured with printheads 608A and 608C being aligned in a row separated by a distance that is approximately the width of printhead 608B so the printheads are arranged in a staggered array to form a line of drops in a cross-process direction across the web W. The manifold inlet connectors 650A, 650B, and 650C are disconnected from the supply lines 618A, 618B, and 618C and manifold outlet connectors 654A, 654B, and 654C are disconnected from the waste ink lines 634A, 634B, and 634C. Jumpers 658A, 658B, and 658C connect the supply lines 618A, 618B, and 618C to waste ink lines 634A, 634B, and 634C, respectively. The ink supply reservoir 604 is configured with three chambers, one for each printhead. The chambers are separated from one another by walls that are internal to the supply tank 604. Each chamber is supplied by an ink source to maintain the distance D between the faceplates of the printheads and the ink levels in the chambers of ink supply tank 604.

Figure 2:
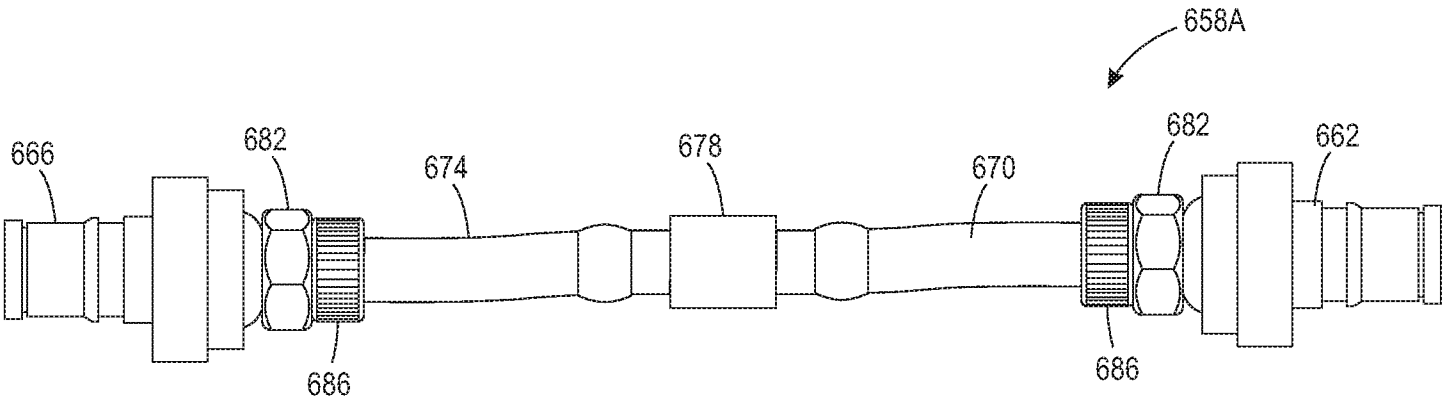
FIG. 2 is a schematic diagram of the jumper used in the system of FIG. 1.

One of the jumpers 658A is shown in FIG. 2. As used in this document, the term "jumper" means a conduit having a first end and a second end and the conduit is configured to enable fluid flow through the conduit in one direction only and to present a pressure drop to the fluid flow through the conduit that corresponds to a pressure drop across a printhead operatively connected between a waste ink reservoir and an ink supply reservoir in an ink delivery system. The jumper of FIG. 2 includes an inlet connector 662, an outlet connector 666, an inlet tube 670, an outlet tube 674, two securing nuts 682, and a pressure impedance element 678. The inlet tube 670 and the outlet tube 674 are plastic hollow tubes having an inside diameter that enable the tubes to receive a threaded spout that extends from the connectors 662 and 666 and an inlet and an outlet of the pressure impedance element 678. The outside diameter of the inlet and outlet tubes is configured to be received with the knurled collars 686 and the nuts 682 receive the threads of the spouts extending from the connectors 662 and 666 so the nuts can be rotated to secure the connectors to the tubes. Other types of connections are also possible including barbed, flared, threaded, friction, or push-to-fit. In the embodiment of FIG. 2, the pressure impedance element is a check valve configured with a valve seat and a ball sized to fit within the seat so fluid flowing from the inlet tube 670 to the outlet tube 674 displaces the ball from the seat and when the flow stops the ball returns to the seat to prevent backflow from the outlet tube to the inlet tube. The inner diameters of the tubes, the spouts extending from the connectors and the flow path through the check valve are sized to present a pneumatic impedance that corresponds to the pneumatic impedance of one of the printheads 608A, 608B, or 608C. Although a check valve is used in the jumper shown in FIG. 2 to provide a pneumatic impedance element that produces a pressure drop corresponding to a pressure drop across the printhead when the printhead is connected to the ink delivery system 20, other types of devices can be installed between the inlet tube and the outlet tube to achieve the same result. For example, the pressure impedance element 678 can be implemented with a precision orifice in the jumper or tubing that has been necked down to a diameter at a predetermined location that mimics the pressure presented by a printhead. Further, a valve, such as a manually controlled or automatically adjustable valve can be configured to mimic the pressure impedance presented by a printhead.

Figure 3:
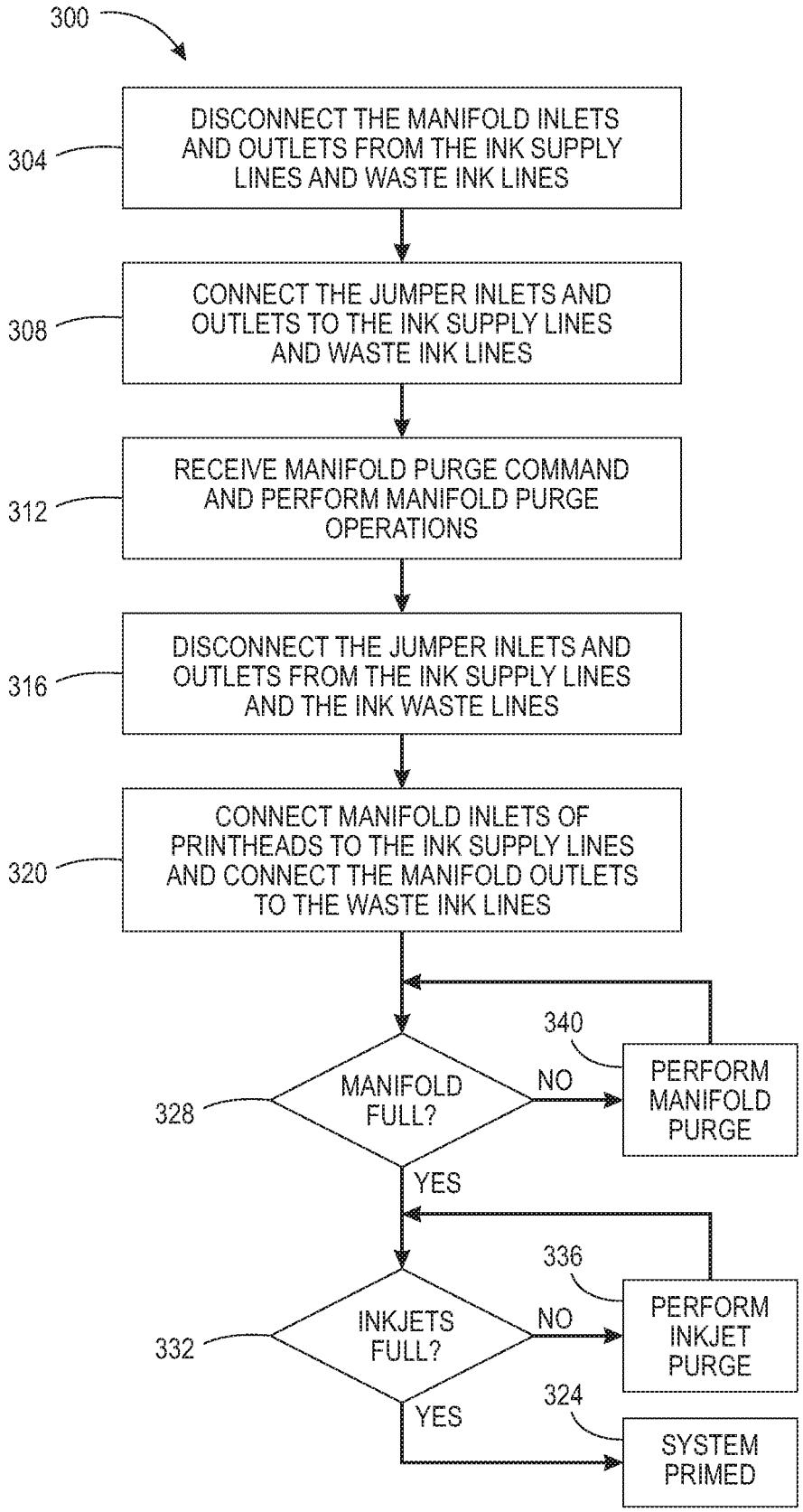
FIG. 3 is a flow diagram of a process for priming the ink delivery system of FIG. 1 with the jumper of FIG. 2.
Figure 4:
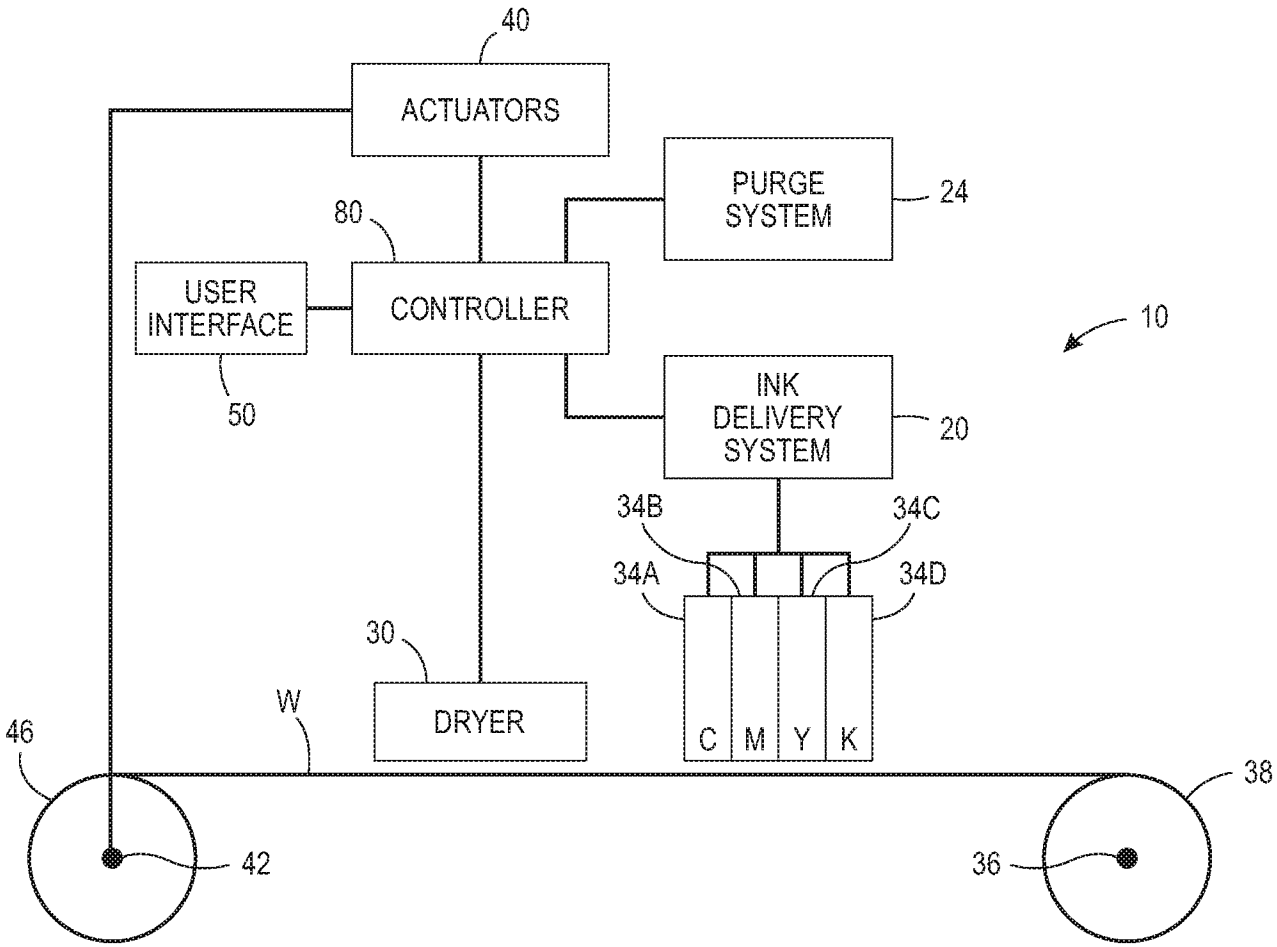
FIG. 4 PRIOR ART
FIG. 4 is a schematic diagram of a prior art ink printer with an ink delivery system that needs priming before printing operations can occur.
Figure 5:
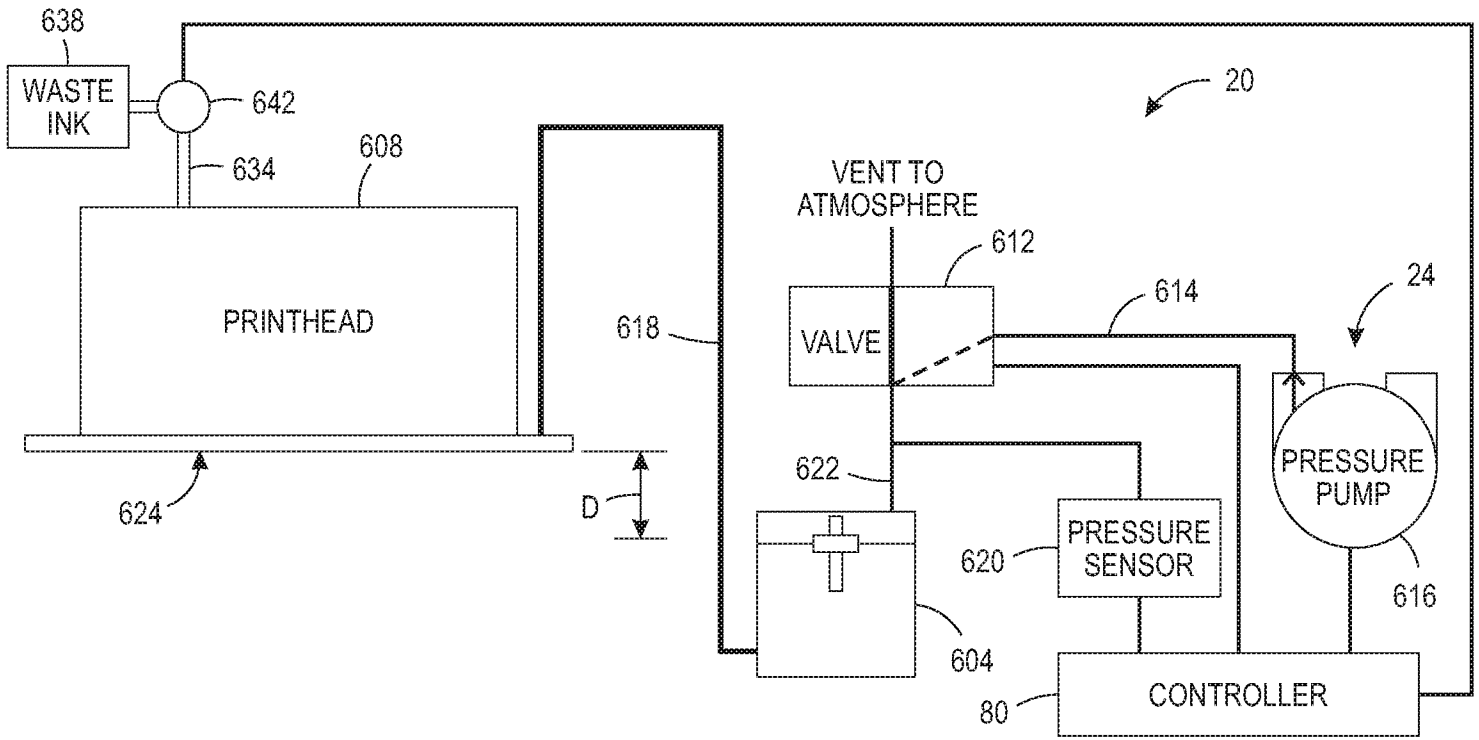
FIG. 5 PRIOR ART
FIG. 5 is a schematic diagram of a prior art ink delivery system used in the printer of FIG. 4.

FIG. 3 is a flow diagram of a process for priming an ink delivery system using a jumper, such as the one depicted in FIG. 2. The process 300 begins with the manifold outlets and manifold inlets being disconnected from the waste ink conduits and the ink supply conduits for a printhead module (block 304). The connectors on the jumper inlet tubes are then connected to the corresponding ink supply conduits and the connectors on the jumper outlet tubes are connected to the corresponding waste ink conduits (block 308). An operator enters a manifold purge command on the user interface 50 and the controller 80' responds by performing a manifold purge as previously described (block 312). That is, the controller 80' operates the valves 612, 642 and the pressure pump 616 to fill the ink supply tubes 618A, 618B, 618C and the waste ink conduits 634A, 634B, and 634C as well as the jumpers 658A, 658B, and 658C. The jumpers are then disconnected from the ink supply conduits and the waste ink conduits (block 316) and the printhead manifold inlets are connected to the ink supply conduits and the printhead manifold outlets are connected to the waste ink conduits (block 320). If the printheads are full of ink, both in the manifolds and the inkjets, the system is primed (block 324). If only the manifolds of the printheads are full (blocks 328 and 332), then an inkjet purge is performed (block 336). If the manifold is partially or completely empty (block 328), then a manifold purge (block 340) is performed and followed by an inkjet purge (block 336). Once the appropriate purges are performed, the printhead module is ready for printing operations (block 324). The controller 80' determines whether the manifold and ink lines are full of ink by operating the pressure source 616, the valve 642, and the valve 612 to apply pressure to the ink reservoir and compare the signal from the pressure sensor 620 to a first threshold that corresponds to a full manifold and to a second threshold that corresponds to full inkjets. If the pressure signal is at or above both thresholds, then the printhead is full and a signal is generated to operate the user interface to indicate the printhead is ready for printing. If the pressure signal is above the first threshold and below the second threshold, then only the manifold is full so an inkjet purge is performed as noted. If the pressure signal is below both thresholds, then neither the manifold nor the inkjets are full of ink so a manifold purge followed by a inkjet purge is performed as noted.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An ink delivery system in a printer comprising:

a jumper having an inlet and an outlet;

an ink supply conduit operatively connected at one end to an ink reservoir and operatively connected at another end to the inlet of the jumper;

a waste ink conduit operatively connected at one end to a waste ink reservoir and operatively connected at another end to the outlet of the jumper;

an air pressure pump operatively connected to the ink reservoir, the air pressure pump being configured to apply pressure to ink in the ink reservoir;

a first valve operatively connected between the ink reservoir and the air pressure pump, the first valve being configured to be moved to a first position where the ink reservoir is vented to atmosphere pressure and to a second position where the air pressure pump applies pressure to the ink reservoir;

a second valve operatively positioned in the waste ink conduit between the waste ink reservoir and the outlet of the jumper, the second valve being configured to be moved to a first position where ink from the jumper outlet flows to the waste ink reservoir and to a second position where ink flow from the jumper outlet to the waste ink reservoir is blocked; and a controller operatively connected to the first valve, the second valve, and the air pressure pump, the controller being configured to operate the first valve to connect the air pressure pump to the ink reservoir, to operate the second valve to connect the output of the jumper to the waste ink reservoir, and to operate the air pressure pump to apply pressure to the ink in the ink reservoir to push ink from the ink reservoir through the ink supply conduit to the jumper and from the outlet of the jumper through the waste ink conduit into the waste ink reservoir.

2. The ink delivery system of claim 1 wherein the controller is further configured to deactivate the air pressure pump when the ink supply conduit, the jumper, and the waste ink conduit are full of ink.

3. The ink delivery system of claim 2 wherein the controller is further configured to detect the ink supply conduit, the jumper, and the waste ink conduit are full of ink by determining pressure in the ink supply conduit, the jumper, and the waste ink conduit is above a predetermined threshold.

4. The ink delivery system of claim 3 further comprising:

a sensor operatively connected to the ink reservoir, the sensor being configured to generate a signal indicative of a pressure in the ink reservoir; and the controller is operatively connected to the sensor to receive the signal generated by the sensor, the controller being further configured to compare the pressure indicated by the signal from the sensor to the predetermined threshold and deactivating the air pressure pump when the pressure indicated by the signal generated by the sensor is above the predetermined threshold.

5. The ink delivery system of claim 4, the jumper further comprising:

a printhead pressure impedance element interposed between the inlet of the jumper and the outlet of the jumper.

6. The ink delivery system of claim 4 wherein the printhead pressure impedance device is a tube that has a predetermined diameter at a predetermined location that corresponds to a pressure drop across a printhead.

7. The ink delivery system of claim 5 wherein the printhead pressure impedance element is a check valve.

8. The ink delivery system of claim 5 wherein the printhead pressure impedance device is an orifice having a predetermined diameter that corresponds to a pressure drop across a printhead.

9. The ink delivery system of claim 5, the jumper further comprising:

a fastening device mounted about the inlet of the jumper, the fastening device mounted about the inlet of the jumper being configured to mate with a connector at the end of the ink supply conduit that connects to the inlet for the jumper; and a fastening device mounted about the outlet of the jumper, the fastening device mounted about the outlet of the jumper being configured to mate with a connector at the end of the waste ink conduit that connects to the outlet for the jumper.

10. The ink delivery system of claim 9 wherein the fastening device mounted about the inlet of the jumper is a nut configured to receive the connector at the end of the ink supply conduit and the fastening device mounted about the outlet of the jumper is a nut configured to receive the connector at the end of the waste ink conduit.

11. A method for priming ink supply conduits and waste ink conduits in an ink delivery system in a printer comprising:

disconnecting one end of an ink supply conduit from an inlet of a manifold of a printhead;

disconnecting one end of a waste ink conduit from an outlet of the manifold of the printhead;

connecting the one end of an ink supply conduit to an inlet of a jumper, another end of the ink supply conduit being connected to an ink reservoir;

connecting the one end of the waste ink conduit to an outlet of the jumper, another end of the waste ink conduit being connected to a waste ink reservoir;

operating with a controller a first valve operatively connected between the ink reservoir and an air pressure pump to connect the air pressure pump to an inlet of a jumper through the ink reservoir when the valve is in a first position;

operating with the controller a second valve operatively connected between the waste ink reservoir and the outlet of the jumper to connect the jumper outlet to the waste ink reservoir when the valve is in a first position; and operating with the controller the air pressure pump to apply pressure to the ink in the ink reservoir to push ink from the ink reservoir through the inlet of the jumper to the outlet of the jumper and into the waste ink reservoir when the first valve and the second valve are both in the first position.

12. The method of claim 11 further comprising:

deactivating the air pressure pump with the controller when the ink supply conduit, the waste ink conduit, and the jumper are full of ink.

13. The method of claim 12 further comprising:

determining with the controller when pressure in the ink supply conduit, the jumper, and the waste ink conduit is above a predetermined threshold.

14. The method of claim 13 further comprising:

receiving with the controller a signal generated by a sensor that indicates a pressure in the ink reservoir;

comparing with the controller the pressure indicated by the signal generated by the sensor to the predetermined threshold; and deactivating the air pressure pump when the pressure indicated by the signal generated by the sensor is above the predetermined threshold.

15. The method of claim 14 wherein ink flowing from the ink reservoir to the waste ink reservoir flows through a check valve between the inlet of the jumper and the outlet of the jumper.

16. The method of claim 14 wherein ink flowing from the ink reservoir to the waste ink reservoir flows through an orifice in the jumper having a predetermined diameter that corresponds to a pressure drop across a printhead.

17. The method of claim 14 wherein ink flowing from the ink reservoir to the waste ink reservoir flows through a tube in the jumper that has a predetermined diameter that corresponds to a pressure drop across a printhead.

18. The method of claim 17 further comprising:

disconnecting the inlet of the jumper from the ink supply conduit;

disconnecting the outlet of the jumper from the waste ink conduit;

connecting the inlet of the manifold of the printhead to the one end of the ink supply conduit;

connecting the outlet of the manifold of the printhead to the one end of the waste ink conduit;

receiving the signal from the sensor;

comparing with the controller the pressure indicated by the signal received from the sensor to a first threshold and a second threshold, the first threshold being greater than the second threshold; and generating a signal that the printhead is ready for printing when the pressure indicated by the signal is greater than the first threshold.

19. The method of claim 18 further comprising:

operating the first valve, the second valve, and the air pressure pump to perform an inkjet purge on the printhead when the pressure indicated by the signal is greater than the second threshold but less than the first threshold.

20. The method of claim 19 further comprising:

operating the first valve, the second valve, and the air pressure pump to perform a manifold purge on the printhead before performing the inkjet purge when the pressure indicated by the signal is less than the second threshold and the first threshold.

* * * * *